US010429758B1

(12) United States Patent
Narita et al.

(10) Patent No.: US 10,429,758 B1
(45) Date of Patent: Oct. 1, 2019

(54) CHARGING MEMBER, CHARGING DEVICE, PROCESS CARTRIDGE, AND IMAGE FORMING APPARATUS

(71) Applicant: FUJI XEROX CO.,LTD., Tokyo (JP)

(72) Inventors: Kosuke Narita, Kanagawa (JP); Shogo Tomari, Kanagawa (JP); Keiko Matsuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/056,556

(22) Filed: Aug. 7, 2018

(30) Foreign Application Priority Data

Mar. 22, 2018 (JP) ..... 2018-054929

(51) Int. Cl.
*G03G 15/02* (2006.01)
*G03G 15/08* (2006.01)

(52) U.S. Cl.
CPC ..... *G03G 15/0233* (2013.01); *G03G 15/0241* (2013.01); *G03G 15/087* (2013.01); *G03G 15/0868* (2013.01)

(58) Field of Classification Search
CPC ..... G03G 15/0233
See application file for complete search history.

(56) References Cited

U.S. PATENT DOCUMENTS

| | | | | |
|---|---|---|---|---|
| 5,741,616 | A * | 4/1998 | Hirano | G03G 15/0818 399/286 |
| 2013/0004205 | A1* | 1/2013 | Gilmartin | G03G 15/0233 399/176 |
| 2016/0291497 | A1* | 10/2016 | Watanabe | G03G 15/0233 |
| 2017/0184992 | A1* | 6/2017 | Morimoto | G03G 15/0233 |
| 2018/0136577 | A1* | 5/2018 | Saito | G03G 15/0216 |

FOREIGN PATENT DOCUMENTS

| | | |
|---|---|---|
| JP | 2008-015323 | 1/2008 |
| JP | 2011-013462 | 1/2011 |

* cited by examiner

*Primary Examiner* — Carla J Therrien
(74) *Attorney, Agent, or Firm* — JCIPRNET

(57) ABSTRACT

A height of convexities in a 0.7-mm-square area of a surface of the charging member is measured at five or more different positions in an axial direction and calculated. A height of a position where the charging member occupies 0.01 area % from a highest portion is defined as a reference height. An average proportion of areas occupied by the charging member at a position 1.7 μm lower than the reference height is 2 area % or less relative to 100 area % of the 0.7-mm-square area.

17 Claims, 7 Drawing Sheets

CHARGING MEMBER, CHARGING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2018-054929 filed Mar. 22, 2018.

BACKGROUND

Technical Field

The present invention relates to a charging member, a charging device, a process cartridge, and an image forming apparatus.

SUMMARY

According to an aspect of the invention, there is provided a contact-charging-type charging member. The height of convexities in a 0.7-mm-square area of the surface of the charging member is measured at five or more different positions in an axial direction under a confocal microscope and calculated. The height of a position where the charging member occupies 0.01 area % from the highest portion is defined as a reference height. The average proportion of areas occupied by the charging member at a position 1.7 μm lower than the reference height is 2 area % or less relative to 100 area % of the 0.7-mm-square area.

BRIEF DESCRIPTION OF THE DRAWINGS

Exemplary embodiments of the present invention will be described in detail based on the following figures, wherein.

DETAILED DESCRIPTION

Hereinafter, exemplary embodiments according to the invention will be described. The following description and Examples illustrate the exemplary embodiments and do not limit the scope of the invention.

In the present specification, if there are two or more substances corresponding to one component in a composition, the amount of the component in the composition refers to the total amount of the two or more substances in the composition, unless stated otherwise.

In the present specification, "electrophotographic photoconductor" is also simply stated as "photoconductor". In the present specification, "axial direction" of a charging member denotes a direction of the rotation axis of the charging member.

In the present specification, "conductive" and "conductivity" indicate a volume resistivity of $1\times10^{14}$ Ωcm or less at 20° C.

Charging Member

The charging member according to an exemplary embodiment is a contact-charging-type charging member. The height of convexities in a 0.7-mm-square area of the surface of the charging member is measured at five or more different positions in an axial direction under a confocal microscope and calculated. The height of a position where the charging member occupies 0.01 area % from the highest portion is defined as a reference height. The average proportion of areas occupied by the charging member at a position 1.7 μm lower than the reference height is 2 area % or less relative to 100 area % of the 0.7-mm-square area.

Hereinafter, the detail of the charging member according to the exemplary embodiment will be described.

The shape of the charging member according to the exemplary embodiment is not particularly limited. The charging member may have a roller shape, a brush shape, a belt (tube) shape, or a blade shape. Among these shapes, a roller-shaped charging member as illustrated in FIG. 1, that is, a charging roller is preferred.

Figure 1A:
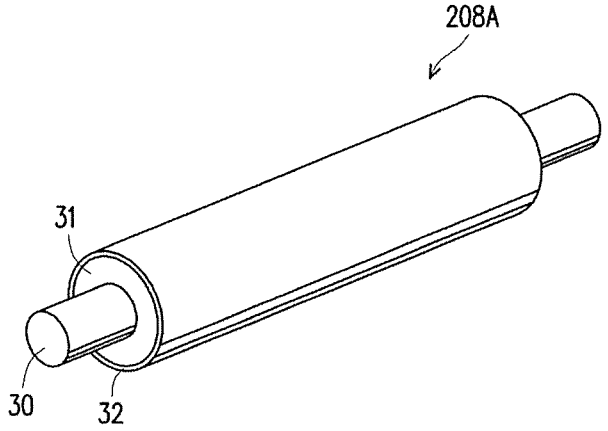
FIG. 1A is an outline view of one example of a charging member according to an exemplary embodiment.

FIG. 1A illustrates an example of the charging member according to the exemplary embodiment. A charging member 208A illustrated in FIG. 1A includes a conductive core body 30, which is a hollow or non-hollow cylindrical member, a conductive elastic layer 31 disposed on the outer circumferential surface of the conductive core body 30, and a surface layer 32 disposed on the outer circumferential surface of the conductive elastic layer 31.

Regarding the charging member according to the exemplary embodiment, the height of convexities in a 0.7-mm-square area of the surface of the charging member is measured at five or more different positions in an axial direction under a confocal microscope and calculated. The height of a position where the charging member occupies 0.01 area % from the highest portion is defined as a reference height. The average proportion of areas occupied by the charging member at a position 1.7 μm lower than the reference height is 2 area or less relative to 100 area % of the 0.7-mm-square area.

The average proportion of the areas is specified as described above, and thus, the charging member according to the exemplary embodiment may have convexities appropriately scattered across the surface of the charging member.

From the viewpoint of suppressing generation of streaks in images, the average proportion of the areas is preferably from 0.1 area % to 2 area %, more preferably from 0.2 area % to 1.8 area %, and particularly preferably from 0.2 area % to 1.3 area %.

In the exemplary embodiment, the average proportion of the areas is measured as follows.

The height of convexities in a 0.7-mm-square area of the surface of the charging member is measured at five or more different positions in the axial direction of the charging member under a confocal microscope.

In each position where the measurement is performed, the height of a position where the charging member occupies 0.01 area % relative to 100 area % of the 0.7-mm-square area from the highest position is defined as a reference height.

At each position where the measurement is performed, the area occupied by the charging member at a position 1.7 μm lower than the reference height (a cross-sectional area of the charging member that is located 1.7 μm lower than the reference height in a direction in which the surface of the charging member extends) is calculated. Then, the proportion of the area is calculated relative to 100 area % of the 0.7-mm-square area.

The proportions are averaged to determine the average proportion of the areas.

Figure 2:
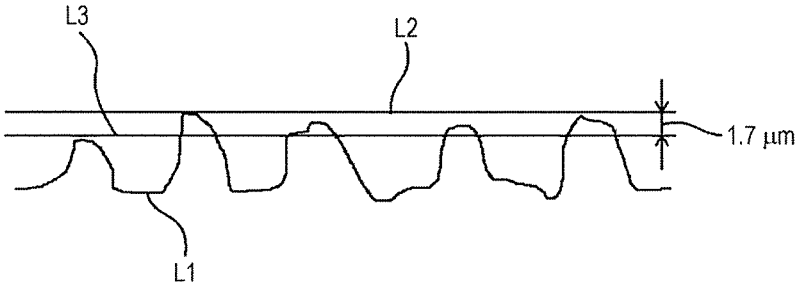
FIG. 2 is a schematic sectional view of a surface portion of another example of the charging member according to the exemplary embodiment.

For example, FIG. 2 is a schematic cross-sectional view of a surface portion of another example of the charging member according to the exemplary embodiment.

On the surface L1 of the charging member, the height of a position where the charging member occupies 0.01 area % relative to 100 area % of the 0.7-mm-square area from the highest portion is defined as a reference height L2. Then, the area occupied by the charging member at a position L3 (cross-sectional area at position L3), which is 1.7 μm lower than the reference height, is calculated.

The charging member according to the exemplary embodiment preferably includes a shaft body having conductivity and more preferably contains particles for forming concavities and convexities in at least one layer disposed on the outer circumferential surface of the shaft body.

The particles for forming concavities and convexities may facilitate production of a charging member having the above-described average proportion of the areas.

The type and content of the particles in forming concavities and convexities and the forming temperature and time for forming each layer may be selected to form a desired shape of concavities and convexities of the surface of the charging member and to control the average proportion of the areas.

The shape may be controlled by a combination of the particle diameter of the particles for forming concavities and convexities and the thickness of the surface layer. For controlling the shape, both the absolute value of the height and the frequency of the convexities may be considered.

For example, when particles having a comparatively large diameter are used and the thickness of the surface layer is reduced, the height of a portion of the particles that protrudes from the layer tends to be increased, and the absolute value of the height tends to be increased. On the other hand, when the content of the particles is decreased, the frequency of the convexities tends to be decreased.

When the absolute value of the height is increased and the frequency of the convexities is decreased, the average proportion of the areas may tend to be comparatively decreased, as a result.

Therefore, as the particle diameter of the particles for forming concavities and convexities increases, the average proportion of the areas tends to be comparatively decreased. As the content of the particles decreases, the average proportion of the areas tends to be comparatively decreased.

Changing the temperature conditions for forming an elastic layer changes the shape of concavities and convexities of the surface of the elastic layer. The frequency distribution of height may be easily changed by applying such a change.

Specifically, as the temperature and time in forming each layer, that is, the total heat applied to the elastic layer increases, the number of gentle concavities and convexities of the elastic layer increases, the frequency distribution of height broadens, and the average proportion of the areas tends to be comparatively decreased even if particles having the same size are used in the surface layer.

The charging member according to the exemplary embodiment includes three implementations described below.

In the first implementation of the charging member according to the exemplary embodiment, the charging member includes a shaft body having conductivity and a conductive elastic layer and a surface layer in this order on the outer circumferential surface of the shaft body. The surface layer contains particles for forming concavities and convexities.

Figure 1B:
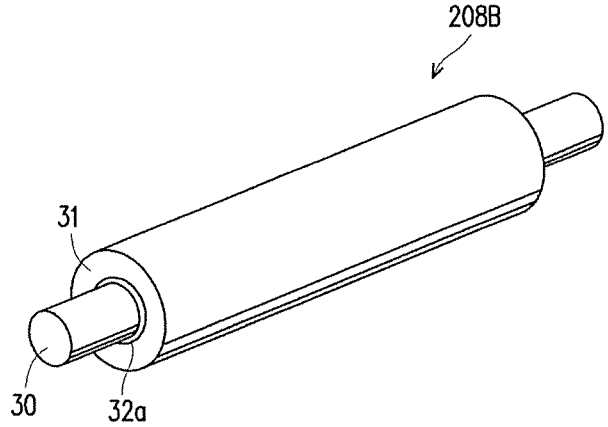
FIG. 1B is an outline view of one example of a charging member according to an exemplary embodiment.

In the second implementation of the charging member according to the exemplary embodiment, the charging member includes a shaft body having conductivity and an adhesive layer and a conductive elastic layer in this order on the outer circumferential surface of the shaft body. The adhesive layer contains particles for forming concavities and convexities. For example, as shown in FIG. 1B, the charging member 208B includes a shaft body 30 having conductivity, an adhesive layer 32*a* and a conductive elastic layer 31, where the adhesive layer 32*a* and the conductive elastic layer 31 are disposed on the outer circumferential surface of the shaft body 30 in an order as illustrated in FIG. 1B.

Figure 1C:
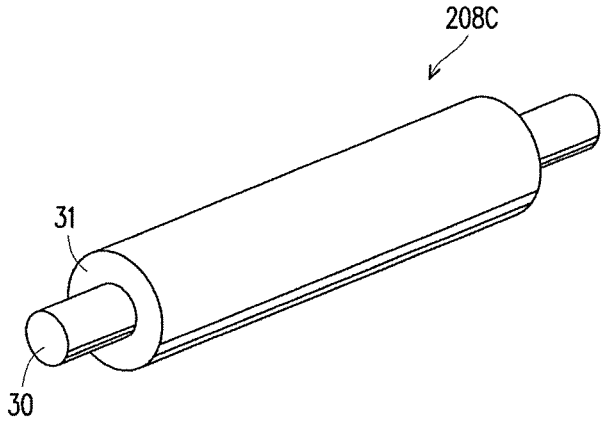
FIG. 1C is an outline view of one example of a charging member according to an exemplary embodiment.

In the third implementation of the charging member according to the exemplary embodiment, the charging member includes a shaft body having conductivity and a conductive elastic layer on the outer circumferential surface of the shaft body. The conductive elastic layer contains particles for forming concavities and convexities. For example, as shown in FIG. 1C, the charging member 208C includes a shaft body 30 having conductivity and a conductive elastic layer 31 being disposed on the outer circumferential surface of the shaft body 30.

In the first to third implementations, layers including particles for forming concavities and convexities are different from each other, and particles for forming concavities and convexities may be different from each other.

In each of the first to third implementations, an adhesive layer, a conductive elastic layer, and a surface layer may be disposed in this order on the outer circumferential surface of the shaft body.

Each implementation will be described below. Particles for Forming Concavities and Convexities in Surface Layer In the first implementation of the charging member according to the exemplary embodiment, the charging member includes a shaft body having conductivity and a conductive elastic layer and a surface layer in this order on the outer circumferential surface of the shaft body. The surface layer contains particles for forming concavities and convexities.

The material of the particles for forming concavities and convexities in the surface layer is not particularly limited. The particles may be inorganic or organic particles.

Examples of the particles for forming concavities and convexities in the surface layer include inorganic particles, such as silica particles, alumina particles, and zircon ($ZrSiO_4$) particles, and resin particles, such as polyamide particles, fluorinated resin particles, and silicone resin particles.

Among such particles, from the viewpoint of suppressing generation of streaks in images, the particles for forming concavities and convexities in the surface layer are preferably resin particles or silica particles, more preferably resin particles, and particularly preferably polyamide particles.

From the viewpoint of suppressing generation of streaks in images, the particles for forming concavities and convexities in the surface layer preferably have a volume-average particle diameter of from 5 μm to 50 μm, more preferably from 8 μm to 40 μm, and particularly preferably from 12 μm to 30 μm.

The method for determining the volume-average particle diameter of the particles according to the exemplary embodiment is as follows. A sample is cut from the layer and used. The sample is observed under an electron microscope, and diameters (the largest diameters) of 100 particles are measured. The diameters are volume-averaged to calculate the volume-average particle diameter of the particles. The average particle diameter may be determined, for example, by using Zetasizer Nano ZS manufactured by SYSMEX CORPORATION.

The particles for forming concavities and convexities in the surface layer may contain one type or two or more types of particles.

The content of the particles for forming concavities and convexities in the surface layer is preferably 1 part by weight or more and 50 parts by weight or less, more preferably 2 parts by weight or more and 30 parts by weight or less, and particularly preferably 3 parts by weight or more and 15 parts by weight or less relative to 100 parts by weight of a binder resin contained in the surface layer.

Particles for Forming Concavities and Convexities in Adhesive Layer

In the second implementation of the charging member according to the exemplary embodiment, the charging member includes a shaft body having conductivity and an adhesive layer and a conductive elastic layer in this order on the outer circumferential surface of the shaft body. The adhesive layer contains particles for forming concavities and convexities.

The material of the particles for forming concavities and convexities in the adhesive layer is not particularly limited. The particles may be inorganic or organic particles.

Examples of the particles for forming concavities and convexities in the adhesive layer include inorganic particles, such as silica particles, alumina particles, and zircon particles, and resin particles, such as polyamide particles, fluorinated resin particles, and silicone resin particles.

Among such particles, from the viewpoint of strength and suppressing generation of streaks in images, the particles for forming concavities and convexities in the adhesive layer are preferably inorganic particles and more preferably zircon particles.

From the viewpoint of suppressing generation of streaks in images, the particles for forming concavities and convexities in the adhesive layer preferably have a volume-average particle diameter of from 110 μm to 300 μm, more preferably from 120 μm to 290 μm, and particularly preferably from 150 μm to 280 μm.

The particles for forming concavities and convexities in the adhesive layer may contain one type or two or more types of particles.

The content of the particles for forming concavities and convexities in the adhesive layer is preferably 1 part by weight or more and 50 parts by weight or less, more preferably 2 parts by weight or more and 30 parts by weight or less, and particularly preferably 3 parts by weight or more and 15 parts by weight or less relative to 100 parts by weight of a binder resin.

Particles for Forming Concavities and Convexities in Conductive Elastic Layer

In the third implementation of the charging member according to the exemplary embodiment, the charging member includes a shaft body having conductivity and a conductive elastic layer on the outer circumferential surface of the shaft body. The conductive elastic layer contains particles for forming concavities and convexities.

The material of the particles for forming concavities and convexities in the conductive elastic layer is not particularly limited. The particles may be inorganic or organic particles.

Examples of the particles for forming concavities and convexities in the conductive elastic layer include inorganic particles, such as silica particles, alumina particles, zircon particles, and carbon black, and resin particles, such as rubber particles, polyamide particles, fluorinated resin particles, and silicone resin particles.

Among such particles, from the viewpoint of conductivity and suppressing generation of streaks in images, the particles for forming concavities and convexities in the conductive elastic layer are preferably rubber particles and more preferably rubber particles containing a conductive agent.

From the viewpoint of charging properties and charge uniformity, the rubber particles may be pulverized rubber particles. The pulverized rubber particles are obtained by collecting charging elastic layers from waste charging members and pulverizing the collected charging elastic layers. The pulverization may be performed by a freeze-pulverization method.

The material of the rubber particles may be an elastic material in the conductive elastic layer.

The conductive agent may be a conductive agent in the conductive elastic layer that will be described later.

From the viewpoint of suppressing generation of streaks in images, the particles for forming concavities and convexities in the conductive elastic layer preferably have a volume-average particle diameter of from 1 μm to 200 μm, more preferably from 5 μm to 100 μm, and particularly preferably from 20 μm to 90 μm.

The particles for forming concavities and convexities in the conductive elastic layer may contain one type or two or more types of particles.

The content of the particles for forming concavities and convexities in the conductive elastic layer is preferably 1 part by weight or more and 100 parts by weight or less, more preferably 2 parts by weight or more and 30 parts by weight or less, and particularly preferably 3 parts by weight or more and 15 parts by weight or less relative to 100 parts by weight of a binder resin.

The charging member according to the exemplary embodiment may contain particles for forming concavities and convexities in one or more layers and preferably includes the particles in only one layer.

Hereinafter, a shaft body having conductivity and components other than particles for forming concavities and convexities in each layer will be described. The components, including particle-shaped components, described below may be contained in addition to the particles for forming concavities and convexities.

Shaft Body Having Conductivity

A shaft body having conductivity is a conductive member that functions as an electrode of and a support for the charging member.

The shaft body having conductivity may be constituted by a conductive material. Examples of such a conductive material include metals and alloys, such as aluminum, copper alloy, and stainless steel; iron subjected to plating, such as chrome plating or nickel plating; and conductive resins. A base material in the exemplary embodiment functions as an electrode and supporting member of the charging roller. Examples of the material of the base material include metals, such as iron (e.g., free-cutting steel), copper, brass, stainless steel, aluminum, and nickel. In the exemplary embodiment, the shaft body is a conductive rod member. Examples of the shaft body include a member (e.g., a resin member or a ceramic member) having an outer circumferential surface subjected to plating and a member (e.g., a resin member or a ceramic member) in which a conductive agent is dispersed. The shaft body may be a hollow member (cylindrical member) or a non-hollow member.

Conductive Elastic Layer

A conductive elastic layer is a layer having conductivity disposed on a shaft body. The conductive elastic layer may be disposed directly on the outer circumferential surface of a conductive core body or on the outer circumferential surface of a conductive core body with an adhesive layer disposed therebetween.

The conductive elastic layer may be one layer or a stacked body in which two or more layers are stacked on each other. The conductive elastic layer may be a conductive foamed elastic layer or a conductive non-foamed elastic layer. The conductive elastic layer may include a conductive foamed elastic layer and a conductive non-foamed elastic layer stacked on each other.

The conductive elastic layer according to an exemplary embodiment includes an elastic material, a conductive agent, and the other additive.

Examples of such an elastic material include polyurethane, nitrile rubber, isoprene rubber, butadiene rubber, ethylene-propylene rubber, ethylene-propylene-diene rubber, epichlorohydrin rubber, epichlorohydrin-ethylene oxide rubber, epichlorohydrin-ethylene oxide-allyl glycidyl ether rubber, styrene-butadiene rubber, acrylonitrile-butadiene rubber, chloroprene rubber, chlorinated polyisoprene, hydrogenated polybutadiene, butyl rubber, silicone rubber, fluoro rubber, and natural rubber, and a mixture thereof. Among such elastic materials, polyurethane, silicone rubber, nitrile rubber, epichlorohydrin rubber, epichlorohydrin-ethylene oxide rubber, epichlorohydrin-ethylene oxide-allyl glycidyl ether rubber, ethylene-propylene-diene rubber, and acrylonitrile-butadiene rubber, and a mixture thereof are preferred.

Examples of such a conductive agent include an electron-conductive agent and an ionic-conductive agent.

Examples of such an electron-conductive agent include powders of the following materials: carbon black, such as furnace black, thermal black, channel black, KETJEN-BLACK, acetylene black, and COLOR BLACK; pyrolytic carbon; graphite; metals and alloys, such as aluminum, copper, nickel, and stainless steel; metal oxides, such as tin oxide, indium oxide, titanium oxide, tin oxide-antimony trioxide solid solution, and tin oxide-indium oxide solid solution; and an insulating material that is surface-treated to have conductivity.

Examples of such an ionic-conductive agent include a perchlorate and chlorate of tetraethylammonium, lauryltrimethylammonium, and benzyltrialkylammonium; and a perchlorate and chlorate of an alkali earth metal, such as magnesium, and an alkali metal, such as lithium.

The conductive agent may be used alone or in a combination of two or more.

The conductive agent may have an average primary particle diameter of 1 nm or more and 200 nm or less.

The content of the electron-conductive agent in the conductive elastic layer is preferably 1 part by weight or more and 30 parts by weight or less and more preferably 15 parts by weight or more and 25 parts by weight or less relative to 100 parts by weight of the elastic material.

The content of the ionic-conductive agent in the conductive elastic layer is preferably 0.1 parts by weight or more and 5 parts by weight or less and more preferably 0.5 parts by weight or more and 3 parts by weight or less relative to 100 parts by weight of the elastic material.

Examples of the other additive mixed in the conductive elastic layer include, softening agents, plasticizing agents, hardening agents, vulcanizing agents, vulcanizing accelerators, vulcanizing accelerating assistants, antioxidants, surfactants, coupling agents, and fillers (e.g., silica, calcium carbonate, and clay minerals).

The conductive elastic layer preferably has a thickness of 1 mm or more and 10 mm or less and more preferably 2 mm or more and 5 mm or less.

The conductive elastic layer may have a volume resistivity of $1\times10^{3}$ Ωcm or more and $1\times10^{14}$ Ωcm or less.

Examples of a method for forming the conductive elastic layer on a shaft body having conductivity include the following methods: a method including extruding, from an extruder, both a cylindrical shaft body having conductivity and a composition for forming a conductive elastic layer in which an elastic material, a conductive agent, and the other additive are mixed, forming a layer of the composition for forming a conductive elastic layer on the outer circumferential surface of the shaft body having conductivity, and heating the layer of the composition for forming the conductive elastic layer to cause a crosslinking reaction to form a conductive elastic layer; and a method including extruding, from an extruder, a composition for forming a conductive elastic layer in which an elastic material, a conductive agent, and the other additive are mixed on the outer circumferential surface of a seamless-belt-shaped shaft body having conductivity, forming a layer of the composition for forming a conductive elastic layer on the outer circumferential surface of the shaft body having conductivity, and heating the layer of the composition for forming the conductive elastic layer to cause a crosslinking reaction to form a conductive elastic layer. The shaft body having conductivity may have an adhesive layer on the outer circumferential surface thereof.

Surface Layer

The charging member according to the exemplary embodiment may further have a surface layer on the conductive elastic layer.

Examples of the binder resin that may be used as the surface layer include urethane, polyester, phenol, acrylic, polyurethane, and epoxy resins and cellulose.

In many cases, conductive particles are included to adjust the resistivity of the surface layer to an appropriate value.

The conductive particles may have a particle diameter of 3 μm or less and a volume resistivity of $10^{9}$ Ωcm or less. Examples of the conductive particles include particles of metal oxides, such as tin oxide, titanium oxide, and zinc oxide, alloys thereof, and carbon black.

From the viewpoint of retaining a long-term fog inhibiting properties, the surface layer preferably has a thickness of 2 μm or more and 10 μm or less and more preferably 3 μm or more and 8 μm or less.

The surface layer may have a volume resistivity of $1\times10^{5}$ Ωcm or more and $1\times10^{8}$ Ωcm or less.

Examples of a method for applying the surface layer include known methods, such as roller coating, blade coating, wire-bar coating, spray coating, immersion coating, bead coating, air-knife coating, and curtain coating. Roll coating does not cause uneven thickness of the surface layer. Thus, roller coating is preferably used in the exemplary embodiment of the invention in which the surface layer is thicker at the end portions than at the center portion. Immersion coating causes uneven thickness of the surface layer, but effectively forms a film with fewer flaws. Thus, immersion coating is preferably used.

Adhesive Layer

The charging member according to the exemplary embodiment may have an adhesive layer between the shaft body having conductivity and the conductive elastic layer.

The adhesive layer interposed between the conductive elastic layer and the conductive core material may be a resin layer. Examples of such a resin layer include polyolefin, acrylic-resin, epoxy-resin, polyurethane, nitrile-rubber, chlorinated-rubber, vinyl chloride-resin, vinyl acetate-resin, polyester, phenol-resin, and silicone-resin layers. The adhesive layer may contain a conductive agent (e.g., the above-described electron-conductive agent or ionic-conductive agent).

From the viewpoint of adherence, the adhesive layer preferably has a thickness of 1 μm or more and 100 μm or less, more preferably 2 μm or more and 50 μm or less, and particularly preferably 5 μm or more and 20 μm or less.

Charging Device, Image Forming Apparatus, and Process Cartridge

A charging device according to an exemplary embodiment is a charging device that includes the charging member according to the exemplary embodiment and that charges an electrophotographic photoconductor by a contact-charging method.

An image forming apparatus according to an exemplary embodiment is not particularly limited, provided that a charging device according to the exemplary embodiment is included. The image forming apparatus according to the exemplary embodiment may include an electrophotographic photoconductor, a charging device that includes a charging member according to the exemplary embodiment and that charges the electrophotographic photoconductor by a contact-charging method, a latent-image forming device that forms a latent image on the surface of the charged electrophotographic photoconductor, a developing device that develops with a developer containing toner the latent image formed on the surface of the electrophotographic photoconductor and that forms a toner image on the surface of the electrophotographic photoconductor, and a transferring device that transfers the toner image formed on the surface of the electrophotographic photoconductor to a recording medium.

In the image forming apparatus according to the exemplary embodiment, the charging device may use a method in which only a direct-current voltage is applied to the charging member or a method in which an alternating-current voltage superimposed on a direct-current voltage is applied to the charging member.

The image forming apparatus according to the exemplary embodiment may further include at least one device selected from a fixing device that fixes a toner image on a recording medium; a cleaning device that cleans the surface of a photoconductor before charging, after the toner image is transferred; and a discharging device that irradiate the surface of a photoconductor with light to discharge the photoconductor before charging, after the toner image is transferred.

An image forming apparatus according to the exemplary embodiment may be one of a direct-transfer-type apparatus that directly transfers a toner image formed on the surface of an electrophotographic photoconductor to a recording medium and an intermediate-transfer-type apparatus that primarily transfers a toner image formed on the surface of an electrophotographic photoconductor to the surface of an intermediate transfer body and that secondarily transfers the toner image transferred to the surface of the intermediate transfer body to the surface of a recording medium.

A process cartridge according to an exemplary embodiment may be a cartridge that includes at least an electrophotographic photoconductor and a charging device that includes a charging member according to the exemplary embodiment and that charges the electrophotographic photoconductor by a contact-charging method. The process cartridge may be detachably attached to an image forming apparatus.

A process cartridge according to the exemplary embodiment may further include at least one device selected from a developing device, a cleaning device for a photoconductor, a discharging device for a photoconductor, a transferring device, and the like.

Hereinafter, referring to the drawings, structures of a charging device, an image forming apparatus, and a process cartridge according to the exemplary embodiments will be described.

Figure 3:
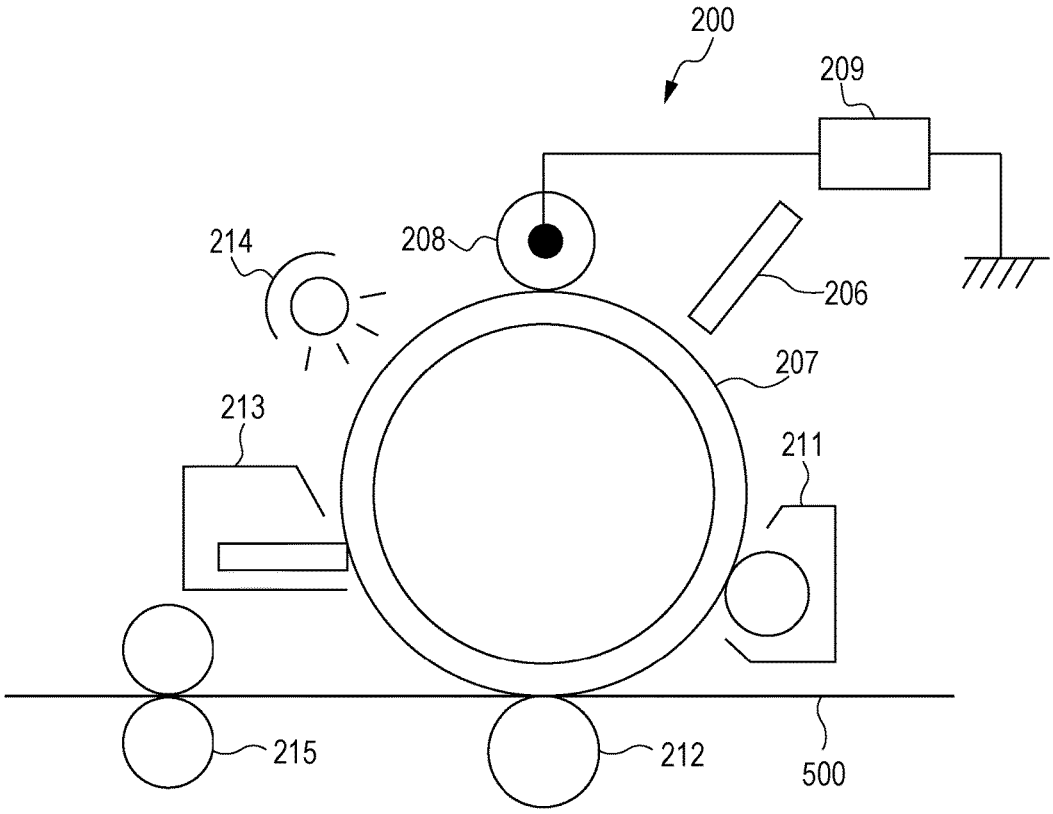
FIG. 3 is an outline view of one example of an image forming apparatus according to an exemplary embodiment.
Figure 4:
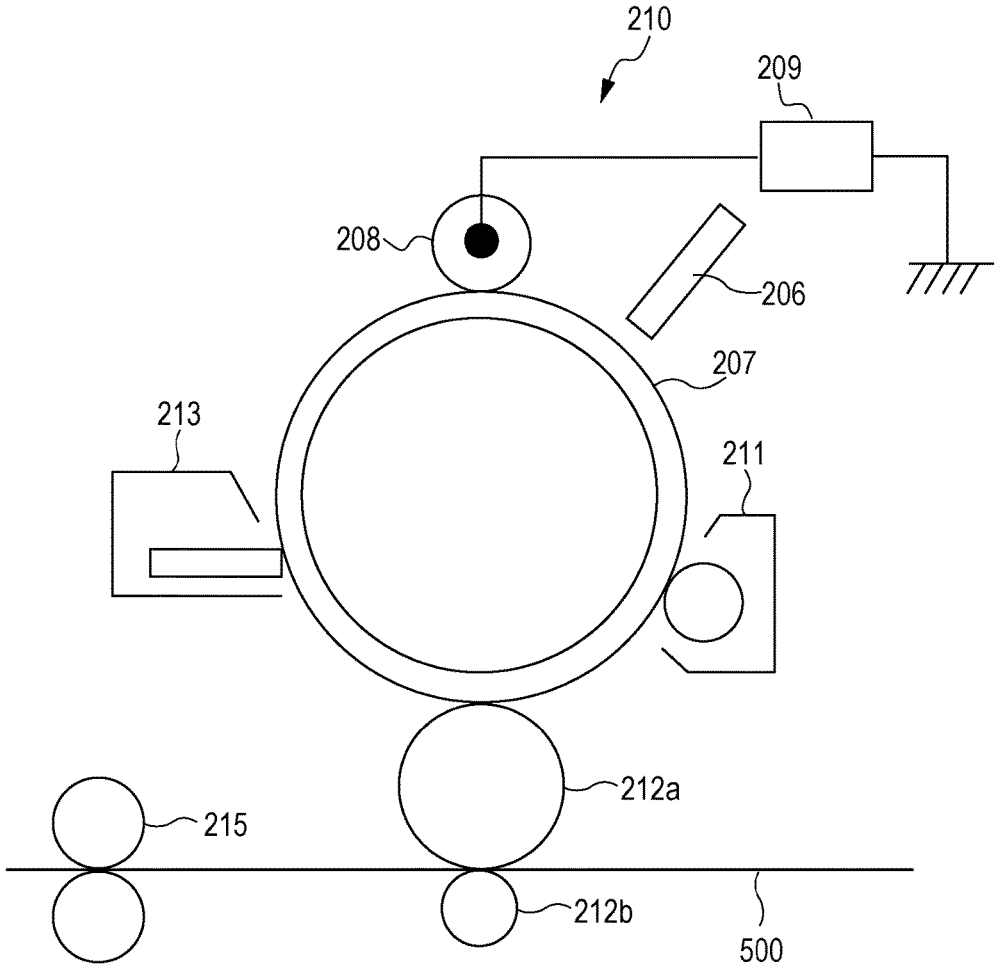
FIG. 4 is an outline view of one example of the image forming apparatus according to the exemplary embodiment.

FIG. 3 is an outline view of a direct-transfer-type image forming apparatus that is one example of the image forming apparatus according to the exemplary embodiment. FIG. 4 is an outline view of an intermediate-transfer-type image forming apparatus that is one example of the image forming apparatus according to the exemplary embodiment.

An image forming apparatus 200 illustrated in FIG. 3 includes an electrophotographic photoconductor (also simply stated as a "photoconductor") 207, a charging device 208 that charges the surface of the photoconductor 207, a power source 209 connecting to the charging device 208, an exposure device 206 that exposes the surface of the photoconductor 207 to form a latent image, a developing device 211 that develops with a developer containing toner the latent image on the photoconductor 207, a transferring device 212 that transfers a toner image on the photoconductor 207 to a recording medium 500, a fixing device 215 that fixes the toner image on the recording medium 500, a cleaning device 213 that removes toner that remains on the photoconductor 207, and a discharging device 214 that discharges the surface of the photoconductor 207. The discharging device 214 is not necessarily included.

An image forming apparatus 210 illustrated in FIG. 4 includes the photoconductor 207, the charging device 208, the power source 209, the exposure device 206, the developing device 211, a primary transferring member 212*a* and a secondary transferring member 212*b* that transfer a toner image on the photoconductor 207 to the recording medium 500, the fixing device 215, and the cleaning device 213. The image forming apparatus 210 may include a discharging device in the same manner as the image forming apparatus 200.

The charging device 208 is a contact-charging-type charging device that is configured by a roller-shaped charging member and that is in contact with the surface of the photoconductor 207 to charge the surface of the photoconductor 207. To the charging device 208, only a direct-current voltage or an alternating-current voltage superimposed on a direct-current voltage is applied from the power source 209.

The exposure device 206 may be an optical device including a light source, such as a semiconductor laser or an LED (light emitting diode).

The developing device 211 is a device that supplies toner to the photoconductor 207. For example, in the developing device 211, a roller-shaped developer holder is in contact with or close to the photoconductor 207 and attaches toner to a latent image on the photoconductor 207 to form a toner image.

Examples of the transferring device 212 include a corona-discharge generator and a conductive roller that is pressed against the photoconductor 207 with the recording medium 500 disposed therebetween.

The primary transferring member 212*a* is, for example, a conductive roller that is in contact with the photoconductor 207 and that rotates. The secondary transferring member 212*b* is, for example, a conductive roller that is pressed against the primary transferring member 212*a* with the recording medium 500 disposed therebetween.

The fixing device 215 is, for example, a heat-fixing device that includes a heating roller and a pressure roller pressed against the heating roller.

The cleaning device 213 is, for example, a device including a cleaning member, such as a blade, a brush, or a roller. Examples of the material of the cleaning blade include urethane rubber, neoprene rubber, and silicone rubber.

The discharging device 214 is, for example, a device that irradiates the surface of the photoconductor 207 with light to discharge the residual potential of the photoconductor 207 after transference is performed. The discharging device 214 is not necessarily included.

Figure 5:
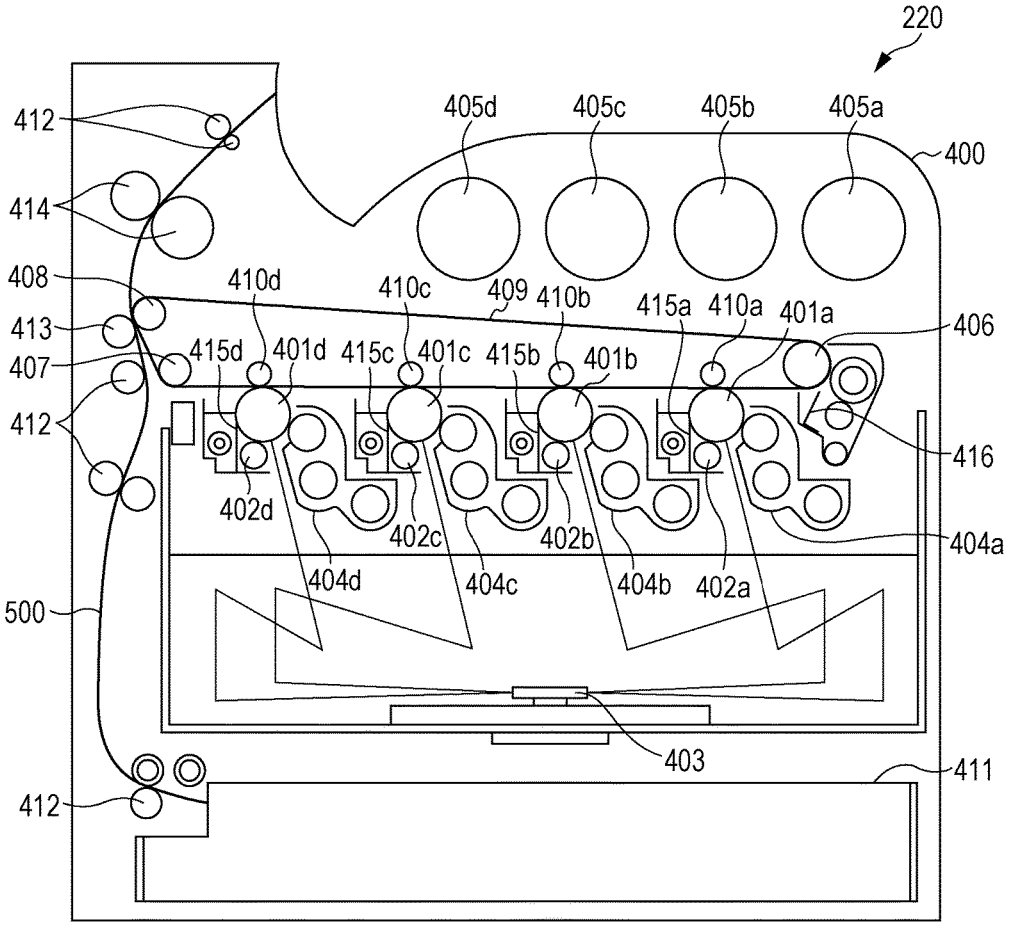
FIG. 5 is an outline view of one example of the image forming apparatus according to the exemplary embodiment.

FIG. 5 is an outline view of a tandem-type and intermediate-transfer-type image forming apparatus that includes four image forming units disposed in parallel and that is one example of the image forming apparatus according to the exemplary embodiment.

An image forming apparatus 220 includes, in a housing 400, four image forming units used for different-colored toners, an exposure device 403 including a laser beam source, an intermediate transfer belt 409, a secondary transferring roller 413, a fixing device 414, and a cleaning device having a cleaning blade 416.

The four image forming units have the same structure. Thus, the structure of the image forming unit including a photoconductor 401*a* will be described as a representative example.

Around the photoconductor 401*a*, a charging roller 402*a*, a developing device 404*a*, a primary transferring roller 410*a*, and a cleaning blade 415*a* are disposed in this order in a rotational direction of the photoconductor 401*a*. The primary transferring roller 410*a* is pressed against the photoconductor 401*a* with the intermediate transfer belt 409 disposed therebetween. Toner accommodated in a toner cartridge 405*a* is supplied to the developing device 404*a*.

The charging roller 402*a* is a contact-charging-type charging device that is in contact with the surface of the photoconductor 401*a* to charge the surface of the photoconductor 401*a*. To the charging roller 402*a*, only a direct-current voltage or an alternating-current voltage superimposed on a direct-current voltage is applied from the power source.

The intermediate transfer belt 409 is stretched by a driving roller 406, an extending roller 407, and a back roller 408 and is moved by rotation of these rollers.

The secondary transferring roller 413 is disposed so as to be pressed against the back roller 408 with the intermediate transfer belt 409 disposed therebetween.

The fixing device 414 is, for example, a heat-fixing device including a heating roller and a pressure roller.

The cleaning blade 416 is a member that removes toner that remains on the intermediate transfer belt 409. The cleaning blade 416 is disposed downstream from the back roller 408 and removes toner that remains on the intermediate transfer belt 409 after transference is performed.

A tray 411, which accommodates the recording medium 500, is disposed in the housing 400. The recording medium 500 in the tray 411 is transferred by a transferring roller 412 to the contact portion between the intermediate transfer belt 409 and the secondary transferring roller 413 and further transferred to the fixing device 414. Thus, an image is formed on the recording medium 500. The recording medium 500 is discharged from the housing 400 after the image is formed.

Figure 6:
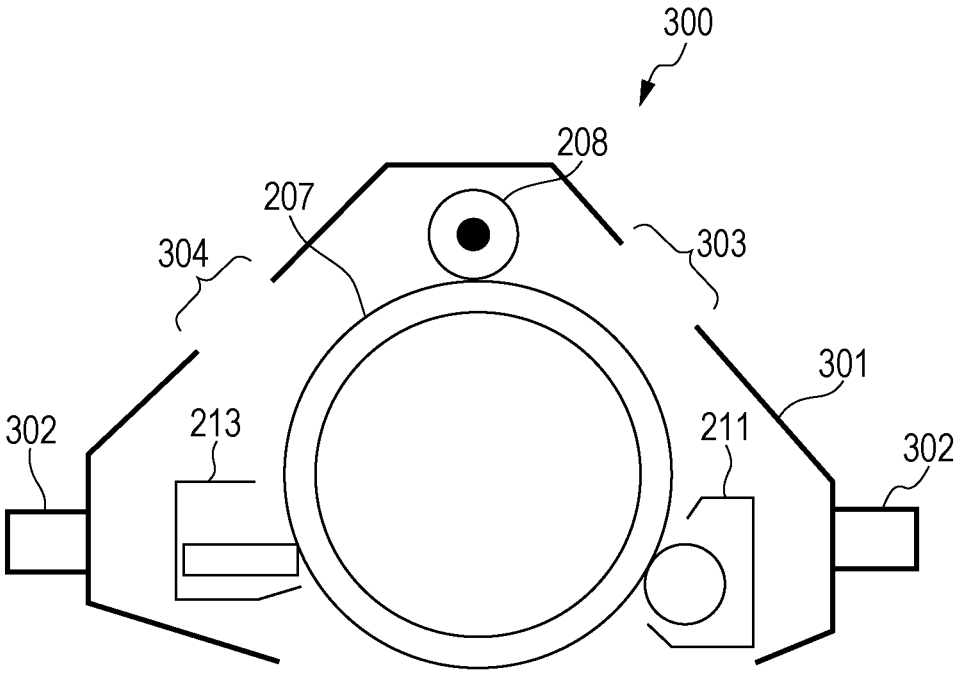
FIG. 6 is an outline view of one example of a process cartridge according to an exemplary embodiment.

FIG. 6 is an outline view of one example of the process cartridge according to the exemplary embodiment. A process cartridge 300 illustrated in FIG. 6 is detachably attached to the main body of an image forming apparatus including, for example, an exposure device, a transferring device, and a fixing device.

The process cartridge 300 is formed by integrating the photoconductor 207, the charging device 208, the developing device 211, and the cleaning device 213 in a housing 301. The housing 301 includes an attachment rail 302 used for detachably attaching the housing 301 to an image forming apparatus, an opening 303 for exposure, and an opening 304 for discharging exposure.

The charging device 208 included in the process cartridge 300 is a contact-charging-type charging device that is configured by a roller-shaped charging member and that is in contact with the surface of the photoconductor 207 to charge the surface of the photoconductor 207. When the process cartridge 300 is attached to an image forming apparatus to form an image, only a direct-current voltage or an alternating-current voltage superimposed on a direct-current voltage is applied from the power source to the charging device 208.

Developer and Toner

A developer used in an image forming apparatus according to the exemplary embodiment is not particularly limited. The developer may be a one-component developer containing only toner or a two-component developer in which toner and a carrier are mixed.

Toner contained in the developer is not particularly limited. The toner includes, for example, a binder resin, a colorant, and a releasing agent. Examples of the binder resin in the toner include polyesters and styrene-acrylic resins.

An external additive may be externally added to the toner. The external additive in the toner may be an inorganic microparticle, such as silica, titania, or alumina.

The toner is prepared by producing toner particles and externally adding an external additive to the toner particles. Examples of a method for producing the toner particles include a kneading-milling method, an aggregation-coalescence method, a suspension-polymerization method, and a dissolution-suspension method. The toner particles may each have a monolayer structure or a so-called core-shell structure constituted by a core portion (core particle) and a covering layer (shell layer) that covers the core portion.

The toner particles preferably have a volume-average particle diameter (D50v) of 2 μm or more and 10 μm or less and more preferably 4 μm or more and 8 μm or less.

A carrier contained in a two-component developer is not particularly limited. Examples of such a carrier include a covered carrier having a core material that is formed of a magnetic powder and that has the surface covered with a resin; a magnetic powder-dispersed carrier having a matrix resin in which magnetic powders are dispersed and mixed; and a resin-impregnated carrier having porous magnetic powders impregnated with a resin.

In the two-component developer, the mixing ratio (weight ratio) of toner to a carrier (toner/carrier) is preferably 1:100 to 30:100 and more preferably 3:100 to 20:100.

Hereinafter, exemplary embodiments of the invention will be described in detail with reference to Examples. The exemplary embodiments of the invention are not limited to the Examples. In the following description, the unit "part" is based on weight, unless stated otherwise.

Example 1

Production of Charging Member

Provision of Base Material

A base material formed of SUM23L is subjected to electroless nickel plating with a thickness of 5 μm and is treated with hexavalent chromium acid to obtain a conductive base material having a diameter of 8 mm.

Formation of Adhesive Layer

Next, the following mixture is mixed with a ball mill for an hour. Then, the mixture is applied to the surface of the base material by brushing to form an adhesive layer having a thickness of 10 μm.

chlorinated polypropylene resin (maleic anhydride-modified chlorinated polypropylene resin, SUPERCHLON 930, manufactured by Nippon Paper Industries CO., LTD.): 100 parts epoxy resin (EP4000, manufactured by ADEKA Corporation): 10 parts conductive agent (carbon black, KETJENBLACK EC, manufactured by Ketjen Black International Company): 2.5 parts Toluene or xylene is used to control viscosity.

Formation of Conductive Elastic Layer epichlorohydrin rubber (Hydrin® T3106, manufactured by Zeon Corporation): 100 parts by weight carbon black (Asahi#60, manufactured by Asahi Carbon Co., Ltd.): 6 parts by weight calcium carbonate (WHITON SB, manufactured by SHIRAISHI CALCIUM KAISHA, LTD.): 20 parts by weight ionic-conductive agent (BTEAC, manufactured by Lion Corporation): 5 parts by weight vulcanizing accelerator: stearic acid (manufactured by NOF CORPORATION): 1 part by weight vulcanizing agent: sulfur (VULNOC R, manufactured by OUCHI SHINKO CHEMICAL INDUSTRIAL CO., LTD.): 1 part by weight vulcanizing accelerator: zinc oxide: 1.5 parts by weight The mixture having the above-described composition is kneaded by using an open-roll mill. The mixture is applied by using an extrusion molding machine to the surface of a conductive support that is formed of SUS303 and that has a diameter of 8 mm, with an adhesive layer disposed between the surface and the mixture, in order to form a roller having a diameter of 12 mm and is heated at 175° C. for 70 minutes to obtain a conductive elastic layer.

Formation of Surface Layer binder resin: N-methoxymethylated nylon 1 (product name: F30K, manufactured by Nagase ChemteX Corporation): 100 parts by weight particle A: carbon black (conductive agent, volume-average particle diameter: 43 nm, product name: MONARCH1000, manufactured by Cabot Corporation): 15 parts by weight particle B: polyamide particles (particles for forming concavities and convexities, volume-average particle diameter: 22 μm, Polyamide 12, manufactured by ARKEMA K.K.): 5 parts by weight The mixture having the above-described composition is diluted with methanol and dispersed by using a beads mill under the following conditions.

bead material: glass bead diameter: 1.3 mm number of propeller rotation: 2,000 rpm dispersion time: 60 min The dispersion liquid obtained as described above is applied to the surface of the conductive elastic layer by dip coating, heat-dried at 150° C. for 30 minutes to form a surface layer having a thickness of 5 μm, thereby obtaining a charging member (charging roller 1) in Example 1.

Example 2

A charging roller in Example 2 is obtained in the same manner as in Example 1 except that 10 parts by weight of $SiO_2$ particles (volume-average particle diameter: 12 μm, SUNSPHERE H121, manufactured by AGC SI-TECH CO., LTD.) are used as the particle B in formation of the surface layer.

Comparative Example 1

A charging roller in Comparative Example 1 is obtained in the same manner as in Example 1 except that 10 parts by weight of polyamide particles (volume-average particle diameter: 10 μm, manufactured by ARKEMA K.K.) are used as the particle B in formation of the surface layer.

Comparative Example 2

A charging roller in Comparative Example 2 is obtained in the same manner as in Comparative Example 1 except that the surface layer has a thickness of 10 μm in formation of the surface layer.

Comparative Example 3

A charging roller in Comparative Example 3 is obtained in the same manner as in Example 1 except that the heating condition is 160° C. and 70 minutes in formation of the conductive elastic layer.

Example 3

A charging roller in Example 3 is obtained in the same manner as in Example 1 except that 10 parts by weight of polyamide particles (particles for forming concavities and convexities, volume-average particle diameter: 15 μm, Polyamide 12, manufactured by ARKEMA K.K.) is used as the particle B in formation of the surface layer.

Example 4

A charging roller in Example 4 is obtained in the same manner as in Example 1 except that the surface layer has a thickness of 7 μm in formation of the surface layer.

Comparative Example 4

A charging roller in Comparative Example 4 is obtained in the same manner as in Example 1 except that 20 parts by weight of $SiO_2$ particles (volume-average particle diameter: 12 μm, SUNSPHERE H121, manufactured by AGC SI-TECH CO., LTD.) are used as the particle B and the surface layer has a thickness of 10 μm in formation of the surface layer. Calculation of Assumed Contact Area Proportion Measurement of Shape of Concavities and Convexities under Confocal Microscope and Calculation of Average Proportion of the Areas The height of convexities in a 0.7-mm-square area of the surface of the charging member is measured at five or more different positions in an axial direction under a confocal microscope and calculated. The height of a position where the charging member occupies 0.01 area % from the highest portion is defined as a reference height. The average proportion of areas occupied by the charging member at a position 1.7 μm lower than the reference height relative to 100 area % of the 0.7-mm-square area is calculated as follows. First, to quantify the shape of concavities and convexities of the surface, the height of convexities of the surface is measured in a 0.7-mm-square area at five or more arbitrary positions of the charging roller under a confocal microscope, and information of the height of convexities of the surface is quantified. From the obtained quantified information, the information of the height of convexities is converted into a histogram with a bin width of 0.014 μm. Then, the height of convexities with respect to the area proportion is calculated. The height of a position where the charging member occupied 0.01 area % from the highest portion is defined as a reference height. The average proportion of areas occupied by the charging member at a level 1.7 μm lower than the reference height is calculated.

Evaluation of Image Quality Preservability (Image Quality Failure with Stain Streaks (Streak Flaws) Caused by Stains on Charging Roller)

A charging roller obtained in each of the above-described Examples and Comparative Examples is integrated in a modified DocuCentre SC2020. Under a condition of low temperature and low humidity (10° C., 15% RH), an A4 halftone image having an area coverage of 60% is output to 50,000 sheets. Then, the halftone image is output to one sheet. Image quality preservability is evaluated with grades GO to G5 based on the level of image quality failure with streak flaws that are caused by stains on the charging roller and that are generated in the halftone image. There is no problem in use of an image with G3 or less of streak flaws.

Evaluation results of charging members in Examples 1 to 4 and Comparative Example 1 to 4 are shown in Table 1.

Example 5

A charging roller in Example 5 is obtained in the same manner as in Example 1 except that 5 parts by weight of zircon beads (volume-average particle diameter 250 μm) are added in formation of the adhesive layer.

Example 6

A charging roller in Example 6 is obtained in the same manner as in Example 1 except that 10 parts by weight of zircon beads (volume-average particle diameter 125 μm) are added in formation of the adhesive layer.

Comparative Example 5

A charging roller in Comparative Example 5 is obtained in the same manner as in Example 1 except that 10 parts by weight of zircon beads (volume-average particle diameter 100 μm) are added in formation of the adhesive layer.

Comparative Example 6

A charging roller in Comparative Example 6 is obtained in the same manner as in Comparative Example 5 except that the adhesive layer has a thickness of 15 μm in formation of the adhesive layer.

Comparative Example 7

A charging roller in Comparative Example 7 is obtained in the same manner as in Example 1 except that 10 parts by weight of zircon beads (volume-average particle diameter 25 μm) are added in formation of the adhesive layer.

Evaluation results are obtained by using charging members in Examples 5 and 6 and Comparative Examples 5 to 7 in the same manner as in Example 1 and shown in Table 2.

TABLE 1

| | Conductive elastic layer | | Surface layer | | | | | |
|---|---|---|---|---|---|---|---|---|
| | Heating conditions | | Particle B | | | | Evaluation results | |
| | Temperature (° C.) | Time (min) | Material | Volume-average particle diameter (μm) | Amount (Parts by weight) | Thickness (μm) | Average ratio of the areas (%) | Streak flaws |
| Example 1 | 175 | 70 | polyamide | 22 | 5 | 5 | 0.5 | G0 |
| Example 2 | 175 | 70 | $SiO_2$ | 12 | 10 | 5 | 1.8 | G1 |
| Example 3 | 175 | 70 | polyamide | 15 | 10 | 5 | 1.7 | G1 |
| Example 4 | 175 | 70 | polyamide | 22 | 5 | 7 | 1.2 | G1 |
| Comparative Example 1 | 175 | 70 | polyamide | 10 | 10 | 5 | 6.2 | G3 |
| Comparative Example 2 | 175 | 70 | polyamide | 10 | 10 | 10 | 8.5 | G4 |
| Comparative Example 3 | 160 | 70 | polyamide | 22 | 5 | 5 | 2.5 | G3 |
| Comparative Example 4 | 175 | 70 | $SiO_2$ | 12 | 20 | 10 | 4.0 | G3 |

TABLE 2

| | Adhesive layer | | | | | |
|---|---|---|---|---|---|---|
| | Particles for forming concavities and convexities | | | | Evaluation results | |
| | Type | Volume-average particle diameter (μm) | Amount (Parts by weight) | Thickness (μm) | Average ratio of the areas (%) | Streak flaws |
| Example 5 | zircon beads | 250 | 5 | 10 | 0.5 | G0 |
| Example 6 | zircon beads | 125 | 10 | 10 | 1.8 | G1 |
| Comparative Example 5 | zircon beads | 100 | 10 | 10 | 6.2 | G3 |
| Comparative Example 6 | zircon beads | 100 | 10 | 15 | 8.5 | G4 |
| Comparative Example 7 | zircon beads | 25 | 10 | 10 | 9.0 | G4 |

Example 7

A charging roller in Example 7 is obtained in the same manner as in Example 1 except that the particle B is not mixed in formation of the surface layer and 5 parts by weight of freeze-pulverized rubber particles (volume-average particle diameter 80 μm) are added as particles for forming concavities and convexities to the conductive elastic layer.

Example 8

A charging roller in Example 8 is obtained in the same manner as in Example 7 except that 10 parts by weight of freeze-pulverized rubber particles (volume-average particle diameter 30 μm) are added as particles for forming concavities and convexities to the conductive elastic layer.

Example 9

A charging roller in Example 9 is obtained in the same manner as in Example 7 except that 20 parts by weight of freeze-pulverized rubber particles (volume-average particle diameter 15 μm) are added as particles for forming concavities and convexities to the conductive elastic layer.

Example 10

A charging roller in Example 10 is obtained in the same manner as in Example 7 except that 80 parts by weight of freeze-pulverized rubber particles (volume-average particle diameter 10 μm) are added as particles for forming concavities and convexities to the conductive elastic layer.

Comparative Example 8

A charging roller in Comparative Example 8 is obtained in the same manner as in Example 1 except that the particle B is not included in formation of the surface layer.

Comparative Example 9

A charging roller in Comparative Example 9 is obtained in the same manner as in Example 7 except that 100 parts by weight of freeze-pulverized rubber particles (volume-average particle diameter 10 μm) are added as particles for forming concavities and convexities to the conductive elastic layer.

Comparative Example 10

A charging roller in Comparative Example 10 is obtained in the same manner as in Example 7 except that 1 part by weight of freeze-pulverized rubber particles (volume-average particle diameter 80 μm) are added as particles for forming concavities and convexities to the conductive elastic layer.

Comparative Example 11

A charging roller in Comparative Example 11 is obtained in the same manner as in Example 7 except that 1 part by weight of freeze-pulverized rubber particles (volume-average particle diameter 10 μm) are added as particles for forming concavities and convexities to the conductive elastic layer.

Comparative Example 12

A charging roller in Comparative Example 12 is obtained in the same manner as in Example 7 except that 100 parts by weight of freeze-pulverized rubber particles (volume-average particle diameter 80 μm) are added as particles for forming concavities and convexities to the conductive elastic layer.

Evaluation results are obtained by using charging members in Examples 7 to 10 and Comparative Examples 8 to 12 in the same manner as in Example 1 and shown in Table 3.

TABLE 3

| | Particles for forming concavities and convexities in conductive elastic layer | | | Surface layer | Evaluation results | |
|---|---|---|---|---|---|---|
| | Type | Volume-average particle diameter (μm) | Amount (Parts by weight) | Particle B | Average ratio of the areas (%) | Streak flaws |
| Example 7 | freeze-pulverized rubber particles | 80 | 5 | none | 0.6 | G0 |
| Example 8 | freeze-pulverized rubber particles | 30 | 10 | none | 1.0 | G0 |

TABLE 3-continued

| | Particles for forming concavities and convexities in conductive elastic layer | | | Surface | Evaluation results | |
|---|---|---|---|---|---|---|
| | Type | Volume-average particle diameter (μm) | Amount (Parts by weight) | layer Particle B | Average ratio of the areas (%) | Streak flaws |
| Example 9 | freeze-pulverized rubber particles | 15 | 20 | none | 1.5 | G1 |
| Example 10 | freeze-pulverized rubber particles | 10 | 80 | none | 1.8 | G1 |
| Comparative Example 8 | not mixed | — | — | none | 95.0 | G5 |
| Comparative Example 9 | freeze-pulverized rubber particles | 10 | 100 | none | 2.5 | G3 |
| Comparative Example 10 | freeze-pulverized rubber particles | 80 | 1 | none | 3.3 | G3 |
| Comparative Example 11 | freeze-pulverized rubber particles | 10 | 1 | none | 80 | G5 |
| Comparative Example 12 | freeze-pulverized rubber particles | 80 | 100 | none | 85 | G5 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member, comprising:

a shaft body having conductivity;

a conductive elastic layer, disposed on a first outer circumferential surface of the shaft body; and a plurality of convexities on a second outer circumferential surface of the conductive elastic layer of the charging member, wherein heights of all of the convexities in each of five or more different areas of 0.7 square millimeters on the second outer circumferential surface of the charging member are measured, the five or more different areas of 0.7 square millimeters are respectively located at five or more different locations in an axial direction of the charging member, wherein, in each location, the charging member occupies 0.01 area % relative to 100 area % of the area of 0.7 square millimeters at a first position from a highest portion of the convexities, a height of the first position is defined as a reference height, wherein a second position is 1.7 μm lower than the reference height, and an average of proportion of areas occupied by the charging member at the second position in five or more different locations is 2 area % or less relative to 100 area % of the area of 0.7 square millimeters.

2. The charging member according to claim 1, wherein an average proportion of the areas is from 0.1 area % to 2 area %.

3. The charging member according to claim 2, wherein an average proportion of the areas is from 0.2 area % to 1.8 area %.

4. The charging member according to claim 1, further comprising:

a surface layer, wherein the conductive elastic layer and the surface layer in this order on the first outer circumferential surface of the shaft body, wherein the surface layer contains particles for forming concavities and convexities.

5. The charging member according to claim 4, wherein the particles for forming concavities and convexities have a volume-average particle diameter of from 12 μm to 30 μm.

6. The charging member according to claim 4, wherein the particles for forming concavities and convexities are resin particles or silica particles.

7. The charging member according to claim 4, wherein the particles for forming concavities and convexities are polyamide particles.

8. The charging member according to claim 1, further comprising:

an adhesive layer, wherein the adhesive layer and the conductive elastic layer in this order on the first outer circumferential surface of the shaft body, wherein the adhesive layer contains particles for forming concavities and convexities.

9. The charging member according to claim 8, wherein the particles for forming concavities and convexities have a volume-average particle diameter of from 110 μm to 300 μm.

10. The charging member according to claim 8, wherein the particles for forming concavities and convexities are inorganic particles.

11. The charging member according to claim 8, wherein the particles for forming concavities and convexities are zircon particles.

12. The charging member according to claim 1, wherein the conductive elastic layer contains particles for forming concavities and convexities.

13. The charging member according to claim 12, wherein the particles for forming concavities and convexities have a volume-average particle diameter of from 5 μm to 100 μm.

14. The charging member according to claim 12, wherein the particles for forming concavities and convexities are rubber particles.

15. A charging device comprising the charging member according to claim 1.

16. A process cartridge comprising:

an electrophotographic photoconductor; and a charging device that includes the charging member according to claim 1 and that charges the electrophotographic photoconductor, wherein the process cartridge is detachably attached to an image forming apparatus.

17. An image forming apparatus comprising:

an electrophotographic photoconductor;

a charging device that includes the charging member according to claim 1 and that charges the electrophotographic photoconductor;

a latent-image forming device that forms a latent image on a surface of the charged electrophotographic photoconductor;

a developing device that develops with a developer containing toner the latent image formed on the surface of the electrophotographic photoconductor and that forms a toner image on the surface of the electrophotographic photoconductor; and a transferring device that transfers the toner image formed on the surface of the electrophotographic photoconductor to a recording medium.

* * * * *